US008207929B2

(12) United States Patent
Huang et al.

(10) Patent No.: US 8,207,929 B2
(45) Date of Patent: Jun. 26, 2012

(54) SOURCE DRIVER

(75) Inventors: Da-Rong Huang, Tainan County (TW); Chien-Ru Chen, Tainan County (TW)

(73) Assignee: Himax Technologies Limited, Tainan (TW)

( * ) Notice: Subject to any disclaimer, the term of this patent is extended or adjusted under 35 U.S.C. 154(b) by 849 days.

(21) Appl. No.: 12/345,258

(22) Filed: Dec. 29, 2008

(65) Prior Publication Data

US 2010/0164926 A1 Jul. 1, 2010

(51) Int. Cl.
*G09G 3/36* (2006.01)

(52) U.S. Cl. ..... 345/98; 345/100

(58) Field of Classification Search ..... 345/84, 345/87, 89, 98–100, 204, 212, 690
See application file for complete search history.

(56) References Cited

U.S. PATENT DOCUMENTS

| | | | | |
|---|---|---|---|---|
| 6,281,871 | B1 * | 8/2001 | Nohara | 345/100 |
| 7,342,567 | B2 * | 3/2008 | Park | 345/100 |
| 7,667,675 | B2 * | 2/2010 | Kyeong et al. | 345/98 |
| 2010/0033411 | A1 * | 2/2010 | Lee | 345/87 |

* cited by examiner

*Primary Examiner* — Regina Liang
(74) *Attorney, Agent, or Firm* — J.C. Patents

(57) ABSTRACT

A source driver adapted to drive a plurality of data lines on a display panel is disclosed. The source driver includes a first output buffer, a second output buffer, a multiplexer, and a first regulating unit. The first and the second output buffers respectively enhance transmission intensities of a first and a second pixel signals. The first regulating unit regulates a slew rate of the first pixel signal outputted from the first output buffer to match a slew rate of the second pixel signal outputted from the second output buffer. The multiplexer coupled to the regulating unit selectively transmits the first and the second pixel signals to one of the odd data lines and one of the even data line, or to the one of the even data lines or the one of the odd data lines, according to a control signal.

12 Claims, 2 Drawing Sheets

SOURCE DRIVER

BACKGROUND OF THE INVENTION

1. Field of the Invention

The present invention relates to a source driver, and more particularly to a source driver for regulating the slew rate of the output signals.

2. Description of Related Art

A source driver plays an important role in a liquid crystal display (LCD) panel, which converts digital video data into a plurality of voltage signals and delivers the voltage signals to pixels on a display panel for displaying a frame. The source driver includes a plurality of output buffers for enhancing the voltage signals. Due to different characteristics of the electronic elements, and the process variation, the voltage signals outputted from these output buffers may not have identical slew rate for driving pixels on the display panel. As a result, the time for orienting liquid crystals corresponding to locations of the pixels is different, and the representation of the displayed image is uneven.

Generally, in the driving system of the LCD, the polarity of the voltage signal delivered to a certain pixel must be periodically converted for avoiding a residual image phenomenon caused by liquid crystal polarization. There are three types of polarity inversion for driving the display panel, i.e. frame inversion, column inversion, and dot inversion. Taking the dot inversion as an example, the adjacent pixels in one frame are driven by the driving voltages with opposite polarities, and the pixels in the same location of two continuous frames are also driven by the driving voltages with opposite polarities. Usually, the driving voltage with positive polarity is greater than a common voltage coupled to the liquid crystal, and the driving voltage with negative polarity is smaller than the common voltage.

Since the driving voltages with opposite polarities have different voltage levels, the output buffers respectively used for enhancing the driving voltages with different polarities may be composed of different electronic elements. For example, the output buffer suitable for enhancing the driving voltage with positive polarity may include an N-type differential pair for receiving driving voltage with high level and controlling the operation of the output buffer. Contrarily, the output buffer suitable for enhancing the driving voltage with positive polarity may include a P-type differential pair for receiving driving voltage with low level and controlling the operation of the output buffer. As the foregoing description, due to different characteristics of the electronic elements, the voltage signals outputted from the output buffers are likely to have different slew rates.

Obviously, the liquid crystals driven by the voltage signals are oriented in different time due to the different slew rates of the voltage signals. As a result, gray scales of the displayed image are displayed unevenly, and the flickers perceived by human eyes are more serious when performing the polarity inversion. The display quality will be degraded. It is desirable to design a proper source driver to solve the said problem.

SUMMARY OF THE INVENTION

Accordingly, the present invention provides a source driver, which can adjust the slew rates of the pixels signals outputted from different output buffers to be uniform. Therefore, the present invention can avoid the image flickering in a display panel, and further the quality of the display panel is much better.

A source driver adapted to drive a plurality of data lines on a display panel is provided in the present invention. The source driver includes a first output buffer, a second output buffer, a multiplexer and a first regulating unit. The first output buffer has a first input terminal receiving a first pixel signal, and both of a second input terminal and an output terminal coupled together. The first output buffer is used for enhancing the transmission intensity of the first pixel signal. Similarly, a second output buffer has a first input terminal receiving a second pixel signal, and both of a second input terminal and an output terminal coupled together. The second output buffer is used for enhancing the transmission intensity of the second pixel signal. The first regulating unit is coupled between the output terminal of the first output buffer and the multiplexer for regulating a first slew rate of a first pixel signal outputted from the first output buffer to match a second slew rate of a second pixel signal outputted from the second output buffer, and transmitting the first pixel signal to the multiplexer. The multiplexer coupled to the output terminals of the first output buffer and the second output buffer transmits the first pixel signal and the second pixel signal to one of the odd data lines and one of the even data lines, or to the one of the even data line and the one of the odd data lines, respectively.

According to an embodiment of the source driver, the source driver further includes a second regulating unit. The second regulating unit is coupled between the output terminal of the second output buffer and the multiplexer for regulating the second slew rate of the second pixel signal outputted from the second output buffer, and transmitting the second pixel signal to the multiplexer.

According to an embodiment of the source driver, the first pixel signal and the second pixel signal have complementary polarities.

The present invention provides a source driver with the regulating units to adjust the slew rates of the pixel signals outputted from the different output buffers to be uniform. In addition, for the same output buffer, by the operation the regulating unit, a rising time and a falling time of the outputted pixel signal are more symmetric, or namely, the charging ability and the discharging ability of the output buffer are more symmetric, for avoiding the flicker when displaying an image.

In order to make the features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
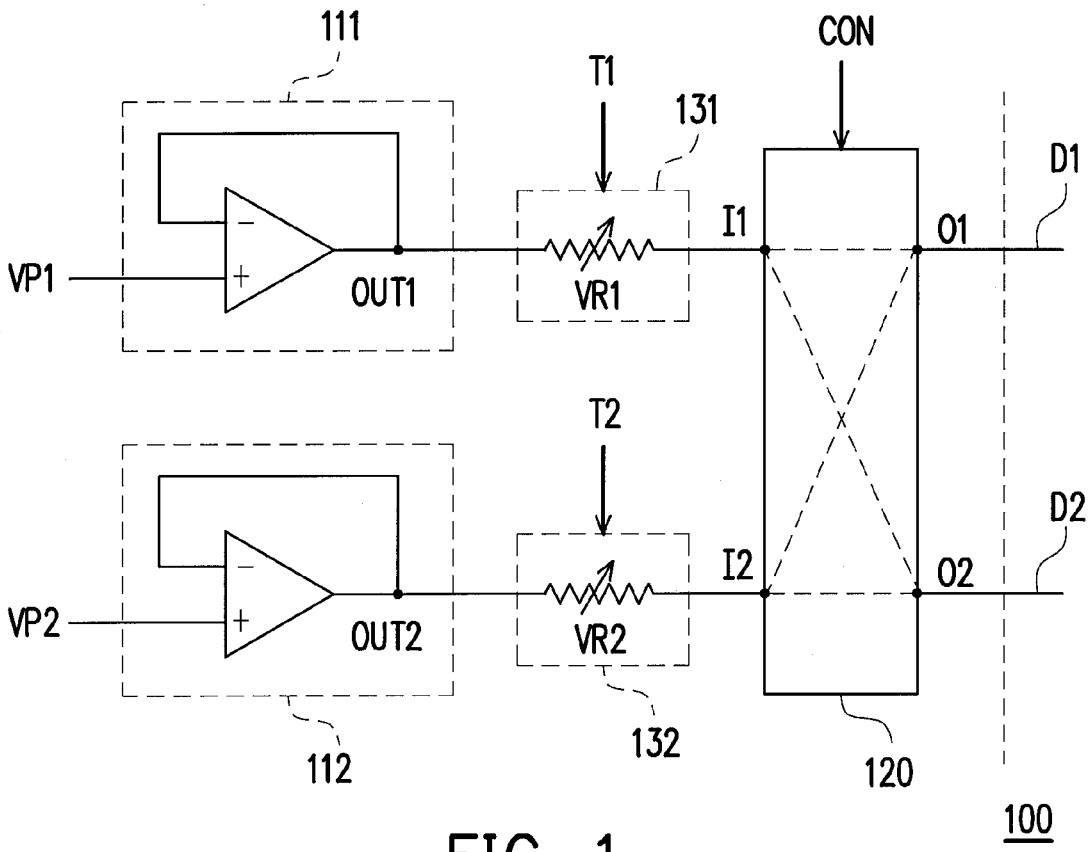
FIG. 1 is a circuit diagram of a source driver according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a circuit diagram of a source driver according to an embodiment of the present invention. Referring to FIG. 1, the source driver 100 is adapted to drive a plurality of data lines, i.e. D1 and D2, on a display panel, such as a liquid crystal display panel or a liquid crystal on silicon panel, wherein the data lines include a plurality of odd data lines (i.e. D1) and a plurality of even data lines (i.e. D2) alternatively arranged on the display panel. The source driver 100 includes output buffers 111 and 112, a multiplexer 120 and regulating units 131 and 132. While a certain scan line is enabled, the source driver 100 enhances the transmission intensities of pixel signals VP1 and VP2 respectively through the output buffers 111 and 112, and then delivers the pixel signals VP1 and VP2 to the data lines D1 and D2 for displaying an image. People ordinarily skilled in the art should know the basic operation of the source driver 100, and the detail is not described more than what is needed herein.

It is assumed that the output buffers 111 and 112 are respectively responsible for enhancing the pixel signals VP1 and VP2 with complementary polarities, i.e. positive polarity and negative polarity. The output buffer 111 has a first input terminal (i.e. non-inverted terminal "+") receiving the pixel signal VP1 with the positive polarity, and a second input terminal (i.e. inverted terminal "−") coupled to an output terminal OUT1 thereof. Similarly, the output buffer 112 has a first input terminal (i.e. non-inverted terminal "+") receiving the pixel signal VP2 with the negative polarity, and a second input terminal (i.e. inverted terminal "−") coupled to an output terminal OUT2 thereof.

The regulating unit 131 is coupled between the output terminal OUT1 of the output buffer 111 and a first input terminal I1 of the multiplexer 120 for regulating a slew rate of the pixel signal VP1 outputted from the output buffer 111. Similarly, the regulating unit 132 is coupled between the output terminal OUT2 of the output buffer 112 and a second input terminal 12 of the multiplexer 120 for regulating a slew rate of the pixel signal VP2 outputted from the output buffer 112. The multiplexer 120 has a first output terminal O1 and a second output terminal O2 respectively coupled to the odd data line D1 and the even data line D2. For performing dot polarity inversion, the multiplexer 120 transmits the pixel signals VP1 and VP2 with complementary polarities, to the odd data line D1 and the even data line D2, or to the even data line D2 and the odd data lines D1, respectively, according to a control signal CON.

Generally, the slew rate of electronic circuit is defined as the maximum rate of change of the output signal. Due to the loading effect and the charging/discharging operation of the output buffer, the slew rate of the pixel signal outputted from the output buffer may become slower, and even the slew rates of rising and falling for the pixel signal outputted from the same output buffer are unsymmetrical. The slower the slew rate of the pixel signal is, the more time the pixel signal is needed to achieve to a predetermined voltage level to drive the liquid crystal. The unsymmetrical slew rates of rising and falling for the pixel signal also result in the occurrence of undesired flickers. In addition, if the slew rates of the pixel signals outputted from the different output buffers are not matched, the representation of the displayed image will be uneven.

Therefore, this embodiment of the present invention utilizes the regulating units 131 and 132 to regulate the slew rates of the pixel signals VP1 and VP2 outputted from the output buffers 111 and 112, respectively, for solving the said problems. Referring to FIG. 1, in the embodiment of the present invention, the regulating units 131 and 132 are respectively implemented by variable resistors VR1 and VR2, for regulating the slew rates of the pixel signals VP1 and VP2 outputted from the output buffers 111 and 112 to be matched. The variable resistor VR1 is coupled between the output terminal OUT1 of the output buffer 111 and the multiplexer 120 for regulating the resistance thereof, and the variable VR2 is coupled between the output terminal OUT2 of the output buffer 112 and the multiplexer 120 for regulating the resistance thereof.

While the slew rate of the pixel signal VP1 is smaller than the slew rate of the pixel signal VP2, the variable resistor VR1 controlled by a trimming signal T1 regulates the resistance thereof to be lower so that the slew rate of the pixel signal VP1 is increased to match the slew rate of the pixel signal VP2. On the other hand, the variable resistor VR2 controlled by a trimming signal T2 regulates the resistance thereof to be higher so that the slew rate of the second pixel signal VP2 is decreased to match the slew rate of the pixel signal VP1. In a preferred embodiment, both of the variable resistors VR1 and VR2 controlled by the trimming signals T1 and T2 can regulate the resistances thereof to be lower to increase the slew rate of the pixel signals VP1 and VP2 to a presetting value, respectively, and to make the slew rate of the pixel signals VP1 and VP2 match each other. Therefore, the slew rate of the pixel signal VP1 and the slew rate of the pixel signal VP2 can be matched each other, or namely to be uniform. In addition, by the operation of each regulating unit, the slew rates of rising and falling for the pixel signal outputted from the same output buffer can be symmetric, so that the symmetry between the charging ability and the discharging ability of each output buffer can be increased for avoiding the flickers.

Figure 2:
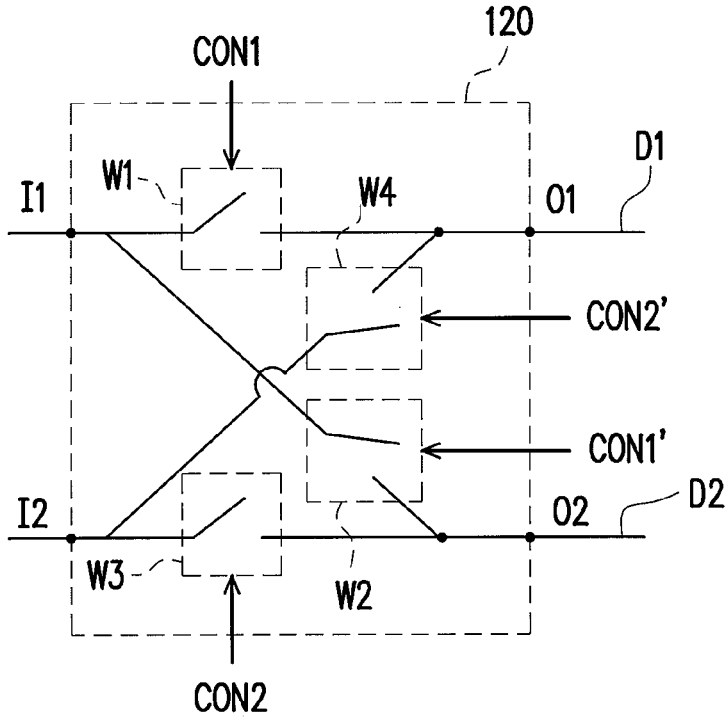
FIG. 2 is a circuit diagram of the multiplexer in the source driver according to an embodiment of the present invention.

Referring to FIG. 1, the multiplexer 120 controlled by the control signal CON receives the pixel signals VP1 and VP2, regulated by the regulating units 131 and 132, for selectively transmitting the pixel signals VP1 and VP2 to the odd data line D1 and the even data line D2, or to the even data line D2 and the odd data line D1, respectively. FIG. 2 is a circuit diagram of the multiplexer 120 according to the embodiment of the present invention in FIG. 1. Referring to FIG. 2, the multiplexer 120 includes switches W1 through W4. The switches W1 and W3 conduct the first input terminal I1 and the second input terminal I1 of the multiplexer 120 to the first output terminal O1 and the second output terminal O2 of the multiplexer 120 according to a first signal CON1 and a second signal CON2 of the control signal CON, respectively. Thereby, the multiplexer 120 can transmit the pixel signals VP1 and VP2 to the odd data line D1 and the even data line D2, respectively. The switches W2 and W4 conduct the first input terminal I1 and the second input terminal I1 of the multiplexer 120 to the second output terminal O2 and the first output terminal O1 of the multiplexer 120 according to a first inverted signal CON1' and a second inverted signal CON2' of the control signal CON, respectively. The first inverted signal CON1' and the second inverted signal CON2' are obtained by inverting the first signal CON1 and the second signal CON2, respectively. Thereby, the multiplexer 120 can transmit the pixel signals VP1 and VP2 to the even data line D2 and the odd data line D1, respectively.

The circuit design schematically shown in FIG. 1 and FIG. 2 only illustrate as an example for one skilled in the art to implement the present invention, rather than limits the scope of the present invention. In order to make people ordinarily skilled in the art can easily put the present invention into practice, the following gives other embodiments to describe the circuit and operation of the regulating units 131 and 132 in detail.

Figure 3:
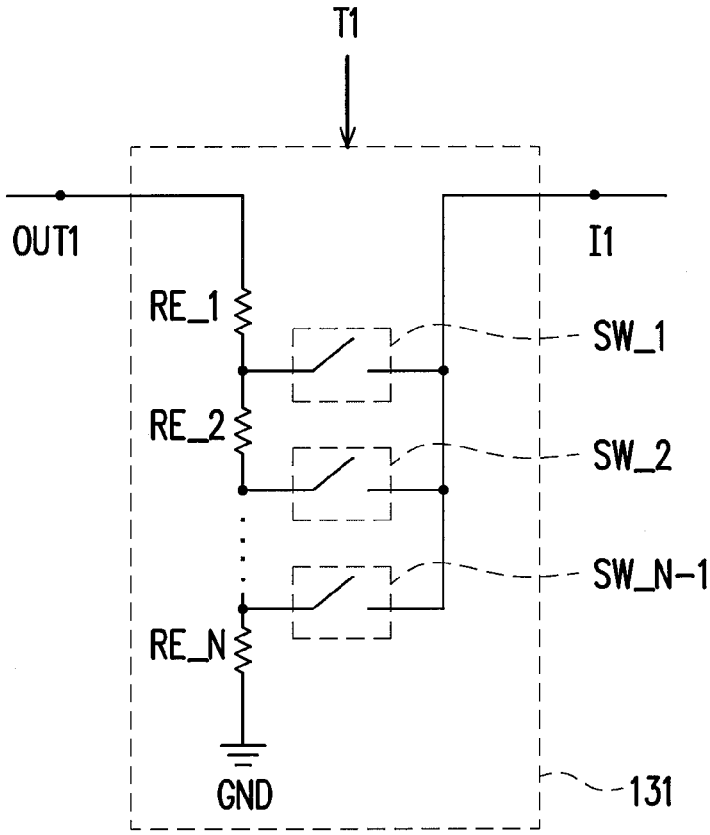
FIG. 3 is a circuit diagram of the first regulating unit in the source driver according to an embodiment of the present invention.

FIG. 3 is a circuit diagram of the regulating unit in the source driver 100 according to an embodiment of the present invention. Referring to FIG. 3, taking the regulating unit 131 as an example, the regulating unit 131 in FIG. 3 includes a plurality of resistors RE_1 through RE_N and a plurality of switches SW_1 through SW_N-1, wherein N is positively number. The resistors RE_1 through RE_N are in series connection, wherein a first terminal and a second terminal of the series-connected resistors RE_1 through RE_N are respectively coupled to the output terminal OUT1 of the output buffer 111 and a ground voltage GND. Each of the switches SW_1 through SW_N-1 is coupled between the corresponding resistor and the first input terminal I1 of the multiplexer 120 for conducting the output terminal of the output buffer 111 to the first input terminal I1 of the multiplexer 120 according to the trimming signal T1. The cooperation of the resistors RE_1 through RE_N and the switches SW_1 through SW_N-1 can function as a variable resistor for regulating the slew rate of the pixel signal VP1.

For example, it is assumed that the trimming signal T1 has N-1 bits, and these bit signals of the trimming signal T1 respectively control the ON/OFF states of the switches SW_1 through SW_N-1. If the switch SW_1 is turned on, the effective resistance between the output terminal OUT1 of the output buffer 11 and the first input terminal I1 of the multiplexer 120 is equivalent to the resistance of the resistor RE-1. To reason by analogy, if the switch SW_2 is turned on, the effective resistance between the terminals OUT1 and I1 is equivalent to a sum of the resistances of the resistors RE_1 and RE_2. Therefore, the regulating unit 131 in FIG. 3 can regulate the slew rate of the pixel signal VP1 as the increase or decrease of the effective resistance.

Figure 4:
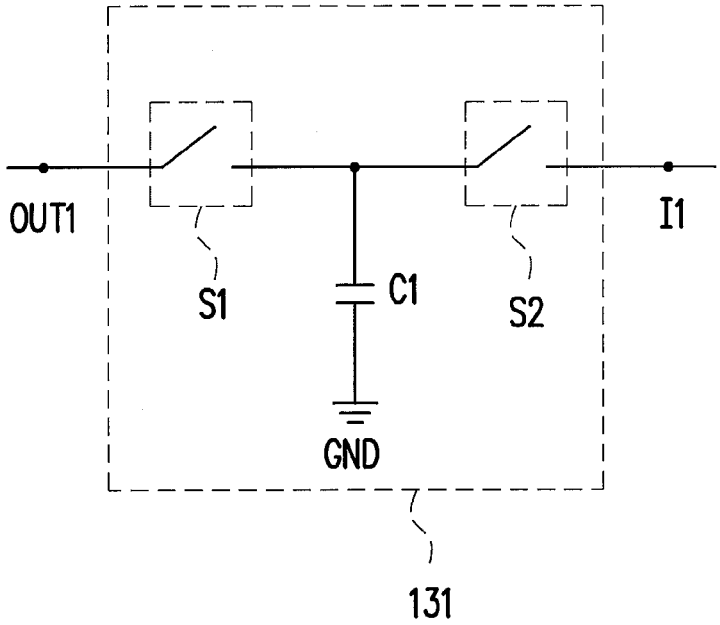
FIG. 4 is a circuit diagram of the first regulating unit in the source driver according to another embodiment of the present invention.

FIG. 4 is a circuit diagram of the regulating unit in the source driver 100 according to an embodiment of the present invention. Referring to FIG. 4, taking the regulating unit 131 as an example, the regulating unit 131 includes switches S1 and S2, and a capacitor C1. As shown in FIG. 4, one terminal of the switch S1 is coupled to the output terminal OUT1 of the output buffer 111, and the other terminal of the first switch S1 is connected to both of one terminal of the capacitor C1 and one terminal of the second switch S2. In addition, the other terminal of the capacitor C1 is coupled to the ground voltage GND, and the other terminal of the second switch S2 is coupled to the first input terminal I1 of the multiplexer 120.

The regulating unit 131 can generates an effective resistance by alternatively conducting the switches S1 and S2. The amount of the effective resistance generated in regulating unit 131 is related to a switching frequency of alternatively conducting the switches S1 and S2, i.e.

$$R = \frac{1}{C \times f},$$

wherein R is the effective resistance, C is a capacitance of the capacitor C1 and f is the switching frequency. Consequently, the regulating unit 131 in FIG. 4 can regulate the slew rate of the pixel signal VP1 as the increase or decrease of the effective resistance generated in the regulating unit 131.

As the foregoing description, the regulating unit 132 in the source driver 100 can be implemented by the circuit illustrated in FIG. 3 or FIG. 4, so that the detail is not iterated.

In summary, the source driver in the said embodiment utilizes the regulating unit to make the slew rates of the pixel signals, outputted from different output buffers, match each other. In addition, through the regulating unit, the slew rates of rising and falling for the pixel signal can be regulated to be symmetric. As a result, the time for orienting the liquid crystals on the display panel can be nearly identical for enhancing lo the display quality, the symmetry between the charging ability and the discharging ability of each output buffer can be increased for avoiding the flickers.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. A source driver, adapted to drive a plurality of data lines on a display panel, wherein the data lines include a plurality of odd data lines and a plurality of even data lines alternatively arranged, comprising:

a first output buffer, having a first input terminal receiving a first pixel signal, and both of a second input terminal and an output terminal coupled together, for enhancing the transmission intensity of the first pixel signal;

a second output buffer, having a first input terminal receiving a second pixel signal, and both of a second input terminal and an output terminal coupled together, for enhancing the transmission intensity of the second pixel signal;

a multiplexer, having a first input terminal coupled to the output terminal of the first output buffer, a second input terminal coupled to the output terminal of the second output buffer, a first output terminal coupled to one of the odd data lines and a second output terminal coupled to one of the even data lines, wherein the multiplexer transmits the first pixel signal and the second pixel signal to the one of the odd data lines and the one of the even data lines respectively, or to the one of the even data lines and the one of the odd data lines respectively according to a control signal; and a first regulating unit, coupled between the output terminal of the first output buffer and the first input terminal of the multiplexer for regulating a first slew rate of the first pixel signal outputted from the first output buffer to match a second slew rate of the second pixel signal outputted from the second output buffer, and transmitting the first pixel signal to the multiplexer.

2. The source driver as claimed in claim 1, further comprising:

a second regulating unit, coupled between the output terminal of the second output buffer and the second input terminal of the multiplexer for regulating the second slew rate of the second pixel signal outputted from the second output buffer, and transmitting the second pixel signal to the multiplexer.

3. The source driver as claimed in claim 2, wherein the second regulating unit comprises:

a variable resistor, having a first terminal coupled to the output terminal of the second output buffer and a second terminal coupled to the second input terminal of the multiplexer for regulating the resistance passed by the second pixel signal according to a trimming signal.

4. The source driver as claimed in claim 2, wherein the second regulating unit comprises:

a plurality of resistors, coupled in series, wherein a first terminal and a second terminal of the series-connected resistors are respectively coupled to the output terminal of the second output buffer and a first voltage; and a plurality of switches, each switch coupled between the corresponding resistor and the second input terminal of the multiplexer for conducting the output terminal of the second output buffer to the second input terminal of the multiplexer according to a trimming signal.

5. The source driver as claimed in claim 2, wherein the second regulating unit comprises:

a first switch, having a first terminal coupled to the output terminal of the second output buffer, and a second terminal;

a first capacitor, having a first terminal coupled to the second terminal of the first switch, and a second terminal coupled to a first voltage; and a second switch, having a first terminal coupled to the second terminal of the first switch, and a second terminal coupled to the second input terminal of the multiplexer;

wherein the first switch and the second switch are alternatively conducted.

6. The source driver as claimed in claim 1, wherein the first regulating unit comprises:

a variable resistor, having a first terminal coupled to the output terminal of the first output buffer and a second terminal coupled to the first input terminal of the multiplexer for regulating the resistance passed by the first pixel signal according to a trimming signal.

7. The source driver as claimed in claim 1, wherein the first regulating unit comprises:

a plurality of resistors, connected in series, wherein a first terminal and a second terminal of the series-connected resistors are respectively coupled to the output terminal of the first output buffer and a first voltage; and a plurality of switches, each switch coupled between the corresponding resistor and the first input terminal of the multiplexer for conducting the output terminal of the first output buffer to the first input terminal of the multiplexer according to a trimming signal.

8. The source driver as claimed in claim 1, wherein the first regulating unit comprises:

a first switch, having a first terminal coupled to the output terminal of the first output buffer, and a second terminal;

a first capacitor, having a first terminal coupled to the second terminal of the first switch, and a second terminal coupled to a first voltage; and a second switch, having a first terminal coupled to the second terminal of the first switch, and a second terminal coupled to the first input terminal of the multiplexer;

wherein the first switch and the second switch are alternatively conducted.

9. The source driver as claimed in claim 1, wherein the multiplexer comprises:

a first switch, having a first terminal coupled to the output terminal of the first output buffer, and a second terminal coupled to the one of the odd data lines for transmitting the first pixel signal to the one of the odd data lines according to a first signal of the control signal;

a second switch, having a first terminal coupled to the first terminal of the first switch, and a second terminal coupled to the one of the even data lines for transmitting the first pixel signal to the one of the even data lines according to a first inverted signal of the control signal;

a third switch, having a first terminal coupled to the output terminal of the second output buffer, and a second terminal coupled to the one of the even data lines for transmitting the second pixel signal to the one of the even data lines according to a second signal of the control signal; and a fourth switch, having a first terminal coupled to the first terminal of the third switch, and a second terminal coupled to the one of the odd data lines for transmitting the second pixel signal to the one of the odd data lines according to a second inverted signal the control signal.

10. The source driver as claimed in claim 1, wherein the first pixel signal and the second pixel signal have complementary polarities.

11. The source driver as claimed in claim 1, wherein the display panel is a liquid crystal display panel.

12. The source driver as claimed in claim 1, wherein the display panel is a liquid crystal on silicon panel.

* * * * *